US008413847B2

(12) United States Patent
Miller

(10) Patent No.: US 8,413,847 B2
(45) Date of Patent: Apr. 9, 2013

(54) ROTARY NOZZLE RECIRCULATION SYSTEMS

(75) Inventor: William A. Miller, Buffalo Grove, IL (US)

(73) Assignee: Fluid Management Operations LLC, Wheeling, IL (US)

( * ) Notice: Subject to any disclaimer, the term of this patent is extended or adjusted under 35 U.S.C. 154(b) by 400 days.

(21) Appl. No.: 12/788,443

(22) Filed: May 27, 2010

(65) Prior Publication Data

US 2011/0290823 A1 Dec. 1, 2011

(51) Int. Cl.
*B67D 7/06* (2010.01)

(52) U.S. Cl.
USPC ..... 222/144; 222/144.5; 222/135; 222/255; 239/113; 239/119; 239/444

(58) Field of Classification Search ..... 222/144, 222/144.5, 135, 132, 255, 109, 110, 504; 239/113, 119, 444
See application file for complete search history.

(56) References Cited

U.S. PATENT DOCUMENTS

| | | | | |
|---|---|---|---|---|
| 2,951,617 | A * | 9/1960 | De Brock | 222/644 |
| 5,078,302 | A * | 1/1992 | Hellenberg | 222/144 |
| 5,119,973 | A * | 6/1992 | Miller et al. | 222/144 |
| 5,228,594 | A | 7/1993 | Aslin | |
| 5,762,098 | A * | 6/1998 | Manzone et al. | 137/312 |
| 5,938,080 | A * | 8/1999 | Haaser et al. | 222/144 |
| 6,237,650 | B1 * | 5/2001 | Ansaloni | 141/237 |
| 6,273,298 | B1 * | 8/2001 | Post | 222/105 |
| 6,769,462 | B2 | 8/2004 | Larson et al. | |
| 7,344,298 | B2 | 3/2008 | Wilmer et al. | |
| 7,527,078 | B2 | 5/2009 | Driessen et al. | |
| 7,597,217 | B2 * | 10/2009 | Mink et al. | 222/135 |
| 7,654,416 | B2 * | 2/2010 | Buining et al. | 222/144 |
| 2007/0056989 | A1 * | 3/2007 | Adema | 222/144 |
| 2007/0266941 | A1 | 11/2007 | Marsh et al. | |
| 2008/0171996 | A1 * | 7/2008 | Lafferty | 604/187 |
| 2008/0212401 | A1 * | 9/2008 | Alessandro | 366/152.1 |

OTHER PUBLICATIONS

International Search Report and Written Opinion for related international application No. PCT/US2011/036724, report dated Feb. 9, 2012.

* cited by examiner

*Primary Examiner* — Kevin P Shaver
*Assistant Examiner* — Donnell Long
(74) *Attorney, Agent, or Firm* — Miller, Matthias & Hull LLP

(57) ABSTRACT

A fluid dispenser is disclosed for dispensing multiple fluids and that includes valve assemblies with rotary recirculation and dispense valves. A table controlled by a motor and a controller moves all of the valve assemblies to either a dispense position or a recirculation position together. The controller selectively operates the pump motors associated with individual canisters of fluid so that the system can dispense a single fluid or multiple fluids at a time. When in the recirculation position, the fluids can be continuously, intermittently or periodically recirculated to maintain the fluids in a homogenous state.

23 Claims, 4 Drawing Sheets

ROTARY NOZZLE RECIRCULATION SYSTEMS

BACKGROUND

1. Technical Field

A recirculation system is disclosed for multiple fluid dispensing and formulation machines wherein the fluids being dispensed have limited amounts of volatile organic compounds (VOCs) and therefore have the propensity to become non-homogeneous and clog the dispense valves. The recirculation system prevents the settling out of heavier materials such as pigments of a colorant or tint, improves the dispense accuracy and reduces the maintenance of the multiple fluid dispensing machines.

2. Description of the Related Art

Systems for dispensing a plurality of different fluids into a container are known. For example, systems for dispensing paint base materials and colorants into a paint container are known. These paint systems may use twenty or more different colorants to formulate a paint mixture. Each colorant is contained in a separate canister or package and may include its own dispensing pump. The colorants and the respective pumps may be disposed on a turntable or along one or more stationary horizontal rows. In a turntable system, the turntable is rotated so that the colorant to be dispensed is moved to a position above the container being filled. In designs using one or more horizontal rows, the container may be moved laterally to the appropriate colorant/pump or the colorants may be dispensed through a manifold.

In paint dispensing applications, precision is essential as the color formulations or paint formulations require the addition of precise amounts of tints or colorants so the chosen color of paint does not vary from container to container. One way in which the precision of a paint dispensing systems is compromised is a non-uniform condition of a colorant or tint caused by a settling out of heavier components of the colorant slurry during storage in the canister and prior to dispensing or between dispenses. Specifically, the actual pigments of colorant slurries tend to be heavier than the remaining components, such as the solvent. As these heavier materials gather or collect towards the bottom of the canister under the force of gravity, the colorant slurry has a non-uniform concentration from the bottom of the canister to the top of the canister. As a result, the heavier pigment materials may be dispensed in a higher concentration when the canister is relatively full and at a lower concentration when the canister is close to being empty. The non-uniformity of the colorant slurry leads to inaccuracies in the final paint formulation.

As a result, there is a need for an improved paint colorant or tint canister for use in automated paint dispensing machines that avoids this problem. Further, the above problems are exacerbated by European and California regulations that are becoming increasingly hostile to the use of volatile organic components (VOCs) in paints and paint colorants. VOCs are very effective solvents at maintaining colorants, pigments and other heavier materials in a uniform slurry. The elimination or restriction of VOCs reduces the time it takes for heavier materials to settle out of a slurry that needs to be uniform for accuracy purposes. For example, low-VOC or no-VOC paint pigments require frequent recirculation to ensure that the final formulation is accurately dispensed.

SUMMARY OF THE DISCLOSURE

In satisfaction of the aforenoted needs, a dispenser for dispensing multiple fluids is disclosed. The dispenser comprises a table coupled to a table motor for rotating the table between at least two positions including a dispense position and a recirculation position. A plurality of canisters, a plurality of pumps, a plurality of pump motors, a plurality of valve assemblies, a plurality of dispense ports and a controller also form part of the disclosed dispenser. Each canister is in communication with its assigned pump. Each pump is in communication with an inlet of its assigned valve assembly. Each pump is also linked to its assigned pump motor. The table is coupled to the plurality of valve assemblies. In the dispense position, the table moves each valve assembly to provide communication between its assigned canister and its assigned dispense port. In the recirculation position, the table moves each valve assembly to provide communication between its respective pump and its respective canister. The controller is linked to the table motor and each pump motor for selectively dispensing fluids when the table and valve assemblies are in the dispense position and for circulating fluids back to their respective canisters when the table and valve assemblies are in the recirculation position.

In a refinement, the controller selectively controls activation of the pump motors so that, in the dispense position, a single fluid may be dispensed if the controller activates only a single pump motor. In contrast, multiple fluids may be dispensed if the controller activates multiple pump motors at a given time.

In a refinement, recirculation may be carried out on a periodic or continuous basis.

In a refinement, each valve assembly comprises a valve housing comprising an inlet in communication with its respective pump and a recirculation outlet in communication with its respective canister. Each valve housing accommodates a valve body that comprises a first end connected to a handle and a second end comprising a dispense passageway that provides communication between the inlet of its associated valve assembly and its associated dispense port when the table and valve assemblies are in the dispense position. The valve body further comprises a recirculation slot that provides communication between the inlet and the recirculation outlet of its respective valve housing when the table and valve assemblies are in the recirculation position.

In another refinement, each handle is connected to a shaft. Each shaft is received in a slot disposed in the table. Rotation of the table between the dispense and recirculation positions cause each shaft and handle to move the valve body between dispense and recirculation positions.

In another refinement, the dispenser also comprises a first sensor linked to the controller for sensing when the table is in the dispense position. In such a refinement, the first sensor may be linked to the controller.

In another refinement, the dispenser may comprise a second sensor for sensing when the table is in the recirculation position. In such a refinement, the second sensor may be linked to the controller.

In another refinement, the table may comprise a plurality of radial slots. Each slot may accommodate a shaft connected to a valve assembly so that rotation of the table between the dispense and recirculation positions causes each shaft to move its respective valve assembly between the dispense and recirculation positions.

One disclosed dispenser for dispensing multiple fluids comprises a table coupled to a table motor for rotating the table between at least two positions including a dispense position and a recirculation position. The dispenser also comprises a plurality of canisters, a plurality of pumps, a plurality of pump motors, a plurality of valve assemblies, a plurality of dispense ports and a controller linked to at least the table motor and each pump motor. Each canister is in communication with its assigned pump. Each pump is in communication with an inlet of its assigned valve assembly. Each pump is also linked to its assigned pump motor. The table is coupled to the plurality of valve assemblies. Each valve assembly comprises a valve housing comprising an inlet in communication with its respective pump and a recirculation outlet in communication with its respective canister. Each valve housing accommodates a valve body comprising a first end connected to a handle and a second end comprising a dispense passageway that provides communication between the inlet of its associated valve assembly and its associated dispense port when the table and valve assemblies are in the dispense position. The valve body further comprises a recirculation slot that provides communication between the inlet and the recirculation outlet of its respective valve housing when the table and valve assemblies are in the recirculation position.

In a refinement, the table is coupled to each valve assembly and, in the dispense position, the table has moved each valve assembly to provide communication between its assigned canister and its assigned dispense port. In the recirculation position, the table has moved each valve assembly to provide communication between its respective pump and its respective canister.

In a refinement, the controller selectively controls activation of the pump motors. For example, in the dispense position, the controller may activate only a single pump so that only a single fluid is dispensed at a given time. In contrast, the controller may activate multiple pump motors so that multiple fluids are dispensed simultaneously.

In a refinement, each handle of each valve assembly is connected to a shaft. Each shaft is received in a radial slot disposed in the table. Rotation of the table between the dispense and recirculation positions causes each shaft and handle to move each valve body between the dispense and recirculation positions.

Sensors may be employed for communicating to the controller when the table is in the dispense position or when the table is in the recirculation position.

A valve assembly is also disclosed which comprises a dispense port and a valve housing comprising an inlet in communication with a pump and a recirculation outlet in communication with a canister. The valve housing also accommodates a valve body comprising a first end connected to a handle and a second end comprising a dispense passageway that provides communication between the inlet of the valve assembly and the dispense port when the valve body is in a dispense position. The valve body further comprises a recirculation slot that provides communication between the inlet and recirculation outlet of the valve housing when the valve body is in the recirculation position.

In a refinement, the recirculation slot extends axially along the valve body to provide communication between the inlet and recirculation outlet of the valve housing when the valve body is in the recirculation position.

In a refinement, the dispense passageway extends transaxially through the valve body.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
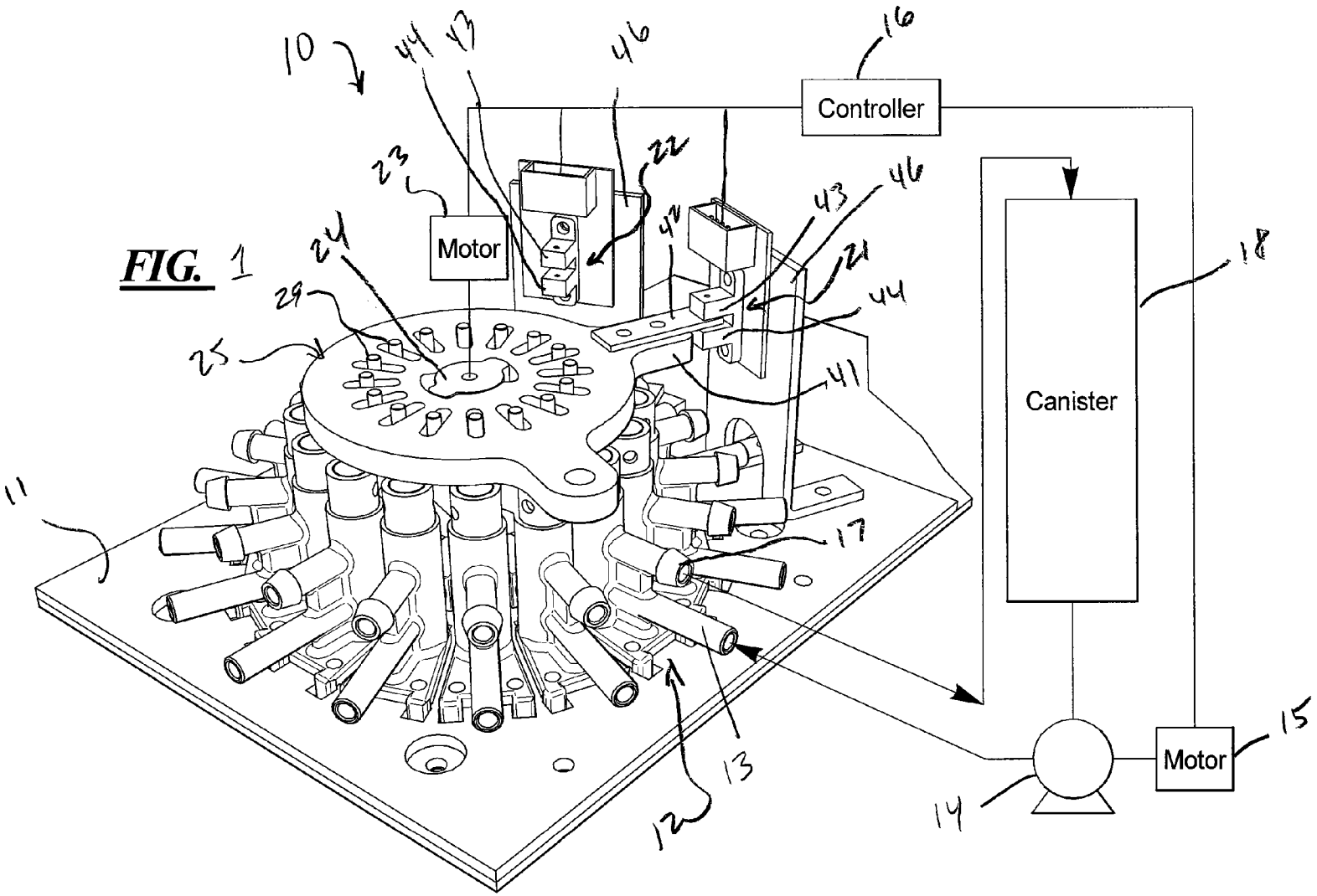
FIG. 1 is a perspective and schematic illustration of a disclosed multiple fluid dispenser illustrating the rotating table, plurality of valve assemblies, sensors, controller and an exemplary canister, pump and pump motor.
Figure 2:
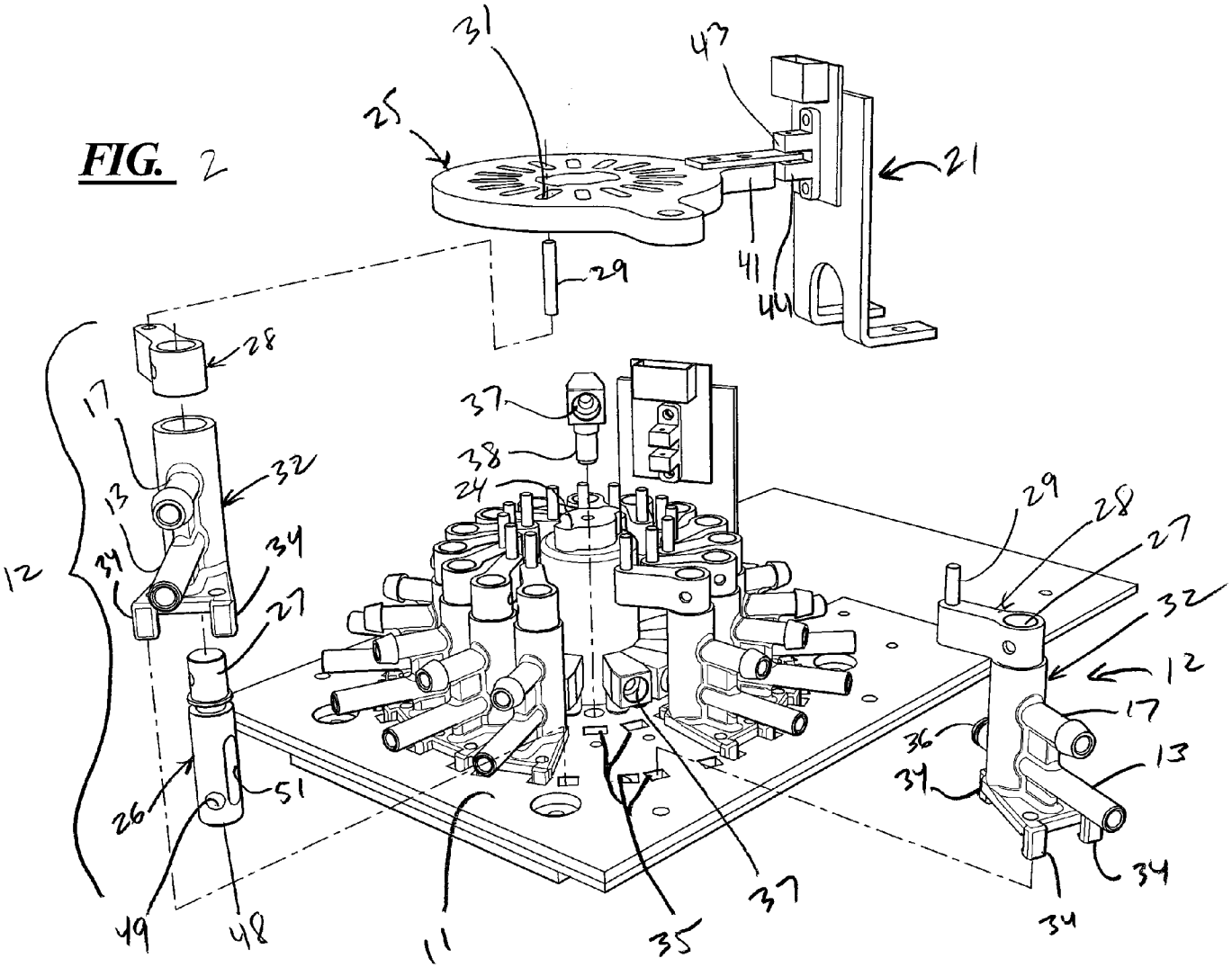
FIG. 2 is a perspective and partial exploded view illustrating the relationship between the sensors, table, and valve assemblies and the connection of the valve assembly to the base or platform.

Turning to FIG. 1, a fluid dispenser 10 is shown which includes a base or platform 11 that supports a plurality of valve assemblies 12, one of which can be seen in an exploded view in FIG. 2. Returning to FIG. 1, each valve assembly includes an inlet 13 in communication with a pump 14, which is linked to a motor 15, which is linked to a controller 16. Each valve assembly 12 also includes a recirculation outlet 17 that is in communication with a canister 18. The dispenser 10 illustrated in FIG. 1 includes sixteen valve assemblies are circumferentially disposed on the platform 11. The platform 11 also supports two sensors 21, 22 that are also linked to the controller 16. The controller 16 is also linked to a motor 23 which is connected to the drive shaft 24 for moving the table 25 and the valve assemblies 12 between a dispense position and a recycle position.

Turning to FIG. 2, each valve assembly 12 includes a valve body 26 with a first end 27 that is coupled to a handle 28. Each handle 28 is coupled to an upwardly protruding shaft 29. Each shaft 29, as shown in FIG. 1, is received in a radially extending slot 31 disposed in the table 25.

Still referring to FIG. 2, each valve assembly 12 also includes a valve housing 32, which includes the inlet 13 and recirculation outlet 17 as discussed above. The valve housings 32 also include downwardly extending pegs 34, which are received in shaped openings 35, disposed in the supporting platform 11. As shown at the right in FIG. 2, each valve assembly 12 also includes an outlet 36 that is coupled to a dispense port 37. Each dispense port 37 includes a downwardly extending nozzle 38. The nozzles 38 are arranged in a circular fashion and extend through the platform 11 for dispensing sixteen different fluids below the platform 11.

Referring to FIGS. 1 and 2 collectively, the table 25 includes an arm 41 that is coupled to a metal plate 42 that can be received between the upper and lower arms 43, 44 of the sensor 21, which may be a proximity sensor. Rotation of the table 25 by the motor 23 and shaft 24 under control by the controller 16 moves the arm 41 and plate 42 from the sensor 21 to the sensor 22, which may also be a proximity sensor with upper and lower arms 43, 44. Thus, the sensors 21, 22 communicate to the controller when the table 25, shafts 29 and valve assemblies 12 are in the dispense or recycle positions. The sensors 21, 22 are mounted to the platform 11 by brackets 46.

Referring to FIG. 2, each valve body 26 includes a second end 48 that includes a dispense passageway 49 and a recirculation slot 51. These features will be described in greater detail in connection with FIGS. 3 and 4.

Figure 3:
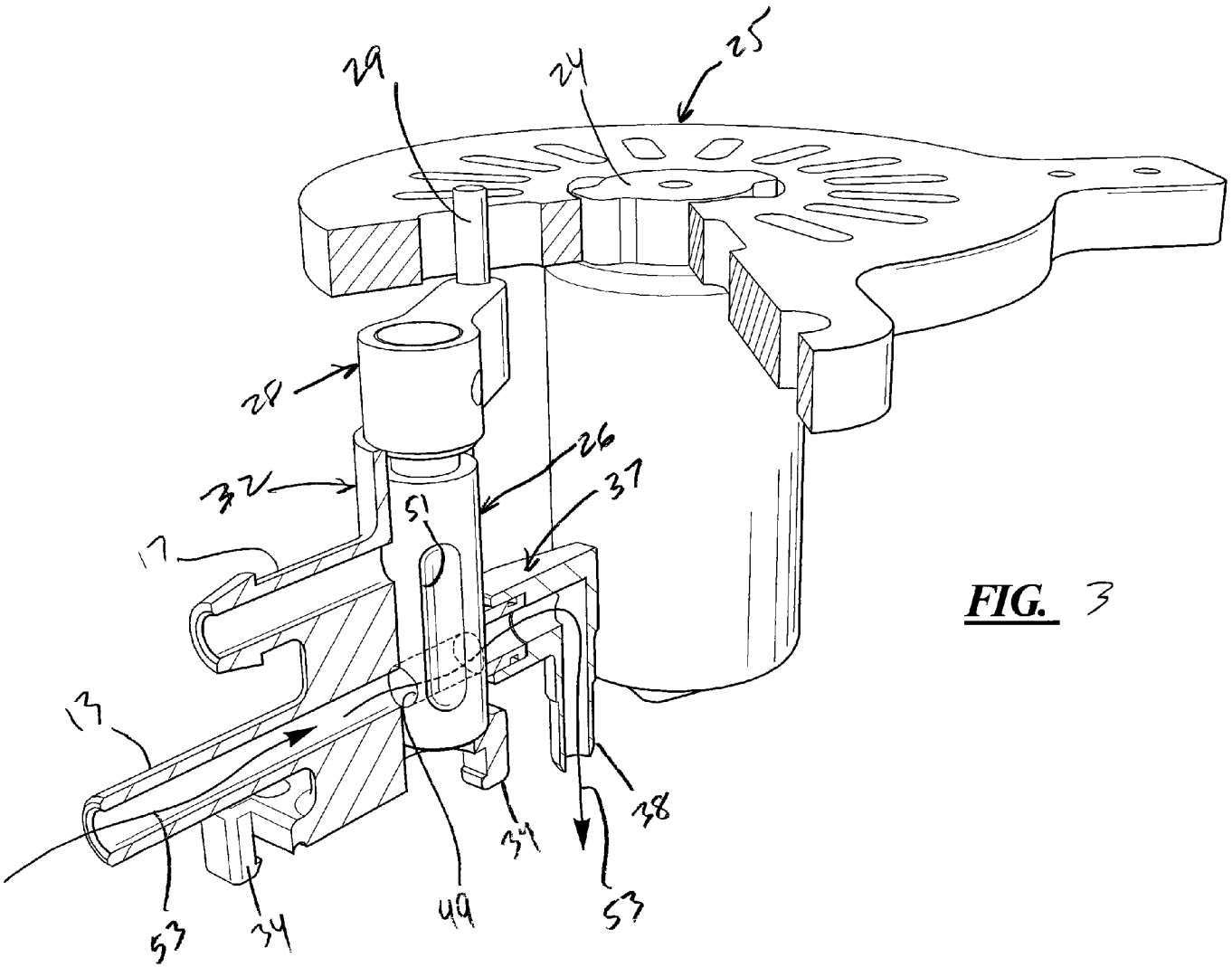
FIG. 3 illustrates the position of a valve assembly in the dispense position.

Turning to FIG. 3, the table 25, the shaft 29, the handle 28, and the valve body 26 have been rotated by the shaft 24 so that the dispense passageway 49 is in alignment with the inlet 13 of the valve body 32 and the dispense port 37. The arrows 53 indicate fluid flow in the dispense direction.

Figure 4:
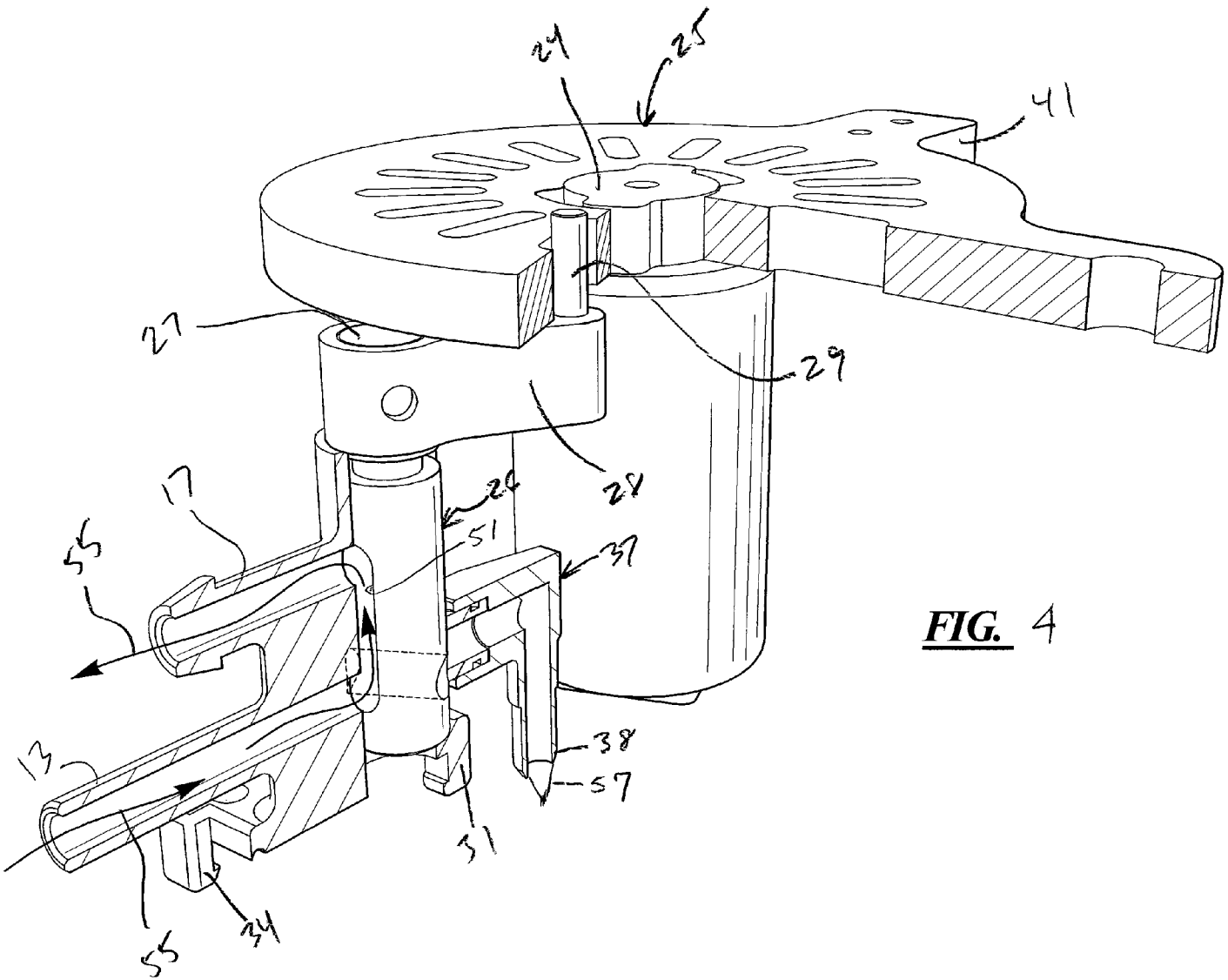
FIG. 4 illustrates the position of a valve assembly in the recirculation position.

Turning to FIG. 4, the table 25, the shaft 29, the handle 28, and the valve body 26 have been rotated by the shaft 24 so that the recirculation slot 51 is in alignment with both the inlet 13 and recirculation outlet 17. The arrows 55 indicate fluid flow in the recirculation direction, or back to the canister 18.

Thus, in the dispense position illustrated in FIG. 3, if the controller 16 has activated the pump motor 15 causing the pump 14 to deliver fluid through the inlet 13, the controller will also cause the shaft 24 to rotate the table and shaft 29 to the position illustrated in FIG. 3 causing the valve body 26 to align the dispense passageway 49 between the inlet 13 and dispense port 37. As a result, fluid flows down through the downwardly extending nozzle 38. The controller 16 may activate one or more pump motors 15 at a time. Thus, the dispenser 10 can dispense a single fluid or multiple fluids simultaneously. Due to the viscosity of the fluids and an optional self-sealing nozzle 57 is shown in FIG. 4, fluids that are not being pumped by the controller 16 will not drip through their respective nozzles unless their associated pump motors 15 and pumps 14 are activated by the controller 16.

One particularly problematic family of colorants is yellow iron oxide colorants. Recirculation of the colorant slurries is one way of minimizing the separation of the materials within the colorant slurry and maintaining homogenization. Further, the recirculation can have the beneficial effect on a thick fluid, such as shear thinning The disclosed dispenser 10 is particularly useful for these types of material and similar materials.

While only certain embodiments have been set forth, alternatives and modifications will be apparent from the above description to those skilled in the art. These and other alternatives are considered equivalents and within the spirit and scope of this disclosure and the appended claims.

What is claimed:

1. A dispenser for dispensing multiple fluids, comprising:

a table coupled to a table motor for rotating the table between at least two positions including a dispense position and a recirculation position;

a plurality of canisters, a plurality of pumps, a plurality of pump motors, a plurality of valve assemblies, a plurality of dispense ports and a controller linked to at least the table motor and each pump motor;

each canister in communication with its assigned pump, each pump in communication with an inlet of its assigned valve assembly, each pump being linked to its assigned pump motor;

the table coupled to the plurality of valve assemblies, when the table is rotated to the dispense position, the table moves each valve assembly to provide communication between its assigned canister and its assigned dispense port, when the table is rotated to the recirculation position, the table moves each valve assembly to provide communication between its respective pump and its respective canister.

2. The dispenser of claim 1 wherein the controller selectively controls activation of the pump motors so that, in the dispense position, a single fluid may be dispensed if the controller activates only a single pump motor or multiple fluids may be dispensed if the controller activates multiple pump motors.

3. The dispenser of claim 1 wherein each valve assembly comprises a valve housing comprising an inlet in communication with its respective pump and a recirculation outlet in communication with its respective canister, each valve housing accommodating a valve body comprising a first end connected to a handle and a second end comprising a dispense passageway that provides communication between the inlet of its associated valve assembly and its associated dispense port when the table and valve assemblies are in the dispense position, the valve body further comprising a recirculation slot that provides communication between the inlet and the recirculation outlet of its respective valve housing when the table and valve assemblies are in the recirculation position.

4. The dispenser of claim 3 wherein each handle is connected to a shaft, each shaft is received in a slots disposed in the table, rotation of the table between the dispense and recirculation positions causing each shaft and handle to move each valve body between the dispense and recirculation positions.

5. The dispenser of claim 1 further comprising a first sensor for sensing when the table is in the dispense position.

6. The dispenser of claim 5 wherein the first sensor is linked to the controller which activates one or more pump motors when the table is in the dispense position.

7. The dispenser of claim 1 further comprising a second sensor for sensing when the table is in the recirculation position.

8. The dispenser of claim 7 wherein the second sensor is linked to the controller which periodically activates one for more pump motors when the table is in the recirculation position.

9. The dispenser of claim 1 wherein the table comprises a plurality of radial slots, each slot accommodating a shaft connected to a valve assembly and rotation of the table between the dispense and recirculation positions causes each shaft to move its respective valve assembly between the dispense and recirculation positions.

10. A dispenser for dispensing multiple fluids, comprising:

a table coupled to a table motor for rotating the table between at least two positions including a dispense position and a recirculation position;

a plurality of canisters, a plurality of pumps, a plurality of pump motors, a plurality of valve assemblies, a plurality of dispense ports and a controller linked to at least the table motor and each pump motor;

each canister in communication with its assigned pump, each pump in communication with an inlet of its assigned valve assembly, each pump being linked to its assigned pump motor;

the table coupled to the plurality of valve assemblies, each valve assembly comprises a valve housing comprising an inlet in communication with its respective pump and a recirculation outlet in communication with its respective canister, each valve housing accommodating a valve body comprising a first end connected to a handle and a second end comprising a dispense passageway that provides communication between the inlet of its associated valve assembly and its associated dispense port when the table and valve assemblies are in the dispense position, the valve body further comprising a recirculation slot that provides communication between the inlet and the recirculation outlet of its respective valve housing when the table and valve assemblies are in the recirculation position.

11. The dispenser of claim 10 wherein the table coupled to the plurality of valve assemblies, in the dispense position, the table moves each valve assembly to provide communication between its assigned canister and its assigned dispense port, in the recirculation position, the table has moved each valve assembly to provide communication between its respective pump and its respective canister.

12. The dispenser of claim 10 wherein the controller selectively controls activation of the pump motors so that, in the dispense position, a single fluid may be dispensed if the controller activates only a single pump motor or multiple fluids may be dispensed if the controller activates multiple pump motors.

13. The dispenser of claim 10 wherein each handle is connected to a shaft, each shaft is received in a radial slot disposed in the table, rotation of the table between the dispense and recirculation positions causing each shaft and handle to move each valve body between the dispense and recirculation positions.

14. The dispenser of claim 10 further comprising a first sensor for sensing when the table is in the dispense position.

15. The dispenser of claim 14 wherein the first sensor is linked to the controller which activates one or more pump motors when the table is in the dispense position.

16. The dispenser of claim 10 further comprising a second sensor for sensing when the table is in the recirculation position.

17. The dispenser of claim 16 wherein the second sensor is linked to the controller which periodically activates one for more pump motors when the table is in the recirculation position.

18. A valve assembly comprising:

a dispense port;

a valve housing comprising an inlet in communication with a pump and a recirculation outlet in communication with a canister, the valve housing accommodating a valve body comprising a first end connected to a handle and a second end comprising a dispense passageway that provides communication between the inlet of the valve assembly and the dispense port when the valve body is in a dispense position, the valve body further comprising a recirculation slot that provides communication between the inlet and the recirculation outlet of the valve housing when valve body is in a recirculation position.

19. The valve assembly of claim 18 wherein the recirculation slot extends axially along the valve body to provide communication between the inlet and recirculation outlet of the valve housing when the valve body is in the recirculation position.

20. The valve assembly of claim 18 wherein the dispense passageway extends trans-axially through the valve body.

21. A dispenser for dispensing multiple fluids, comprising:

a table coupled to a table motor for rotating the table between at least two positions including a dispense position and a recirculation position;

a plurality of canisters, a plurality of pumps, a plurality of pump motors, a plurality of valve assemblies, a plurality of dispense ports and a controller linked to at least the table motor and each pump motor;

each canister in communication with its assigned pump, each pump being linked to its assigned pump motor, and each valve assembly comprises a valve housing comprising an inlet in communication with its respective pump and a recirculation outlet in communication with its respective canister;

each valve housing accommodating a valve body comprising a first end connected to a handle and a second end comprising a dispense passageway that provides communication between the inlet of its associated valve assembly and its associated dispense port when the table and the valve assemblies are in the dispense position, the valve body further comprising a recirculation slot that provides communication between the inlet and the recirculation outlet of its respective valve housing when the table and valve assemblies are in the recirculation position;

each handle is connected to a shaft and each shaft is received in a slot disposed in the table; and the table coupled to the plurality of valve assemblies, when the table is rotated to the dispense position, the table causes each shaft and handle to move its respective valve assembly to provide communication between its assigned canister and its assigned dispense port, when the table is rotated to the recirculation position, the table causes each shaft and handle to move its respective valve assembly to provide communication between its respective pump and its respective canister.

22. A dispenser for dispensing multiple fluids, comprising:

a table coupled to a table motor for rotating the table between at least two positions including a dispense position and a recirculation position;

a plurality of canisters, a plurality of pumps, a plurality of pump motors, a plurality of valve assemblies, a plurality of dispense ports and a controller linked to at least the table motor and each pump motor;

each canister in communication with its assigned pump, each pump in communication with an inlet of its assigned valve assembly, each pump being linked to its assigned pump motor;

the table comprising a plurality of radial slots, each slot accommodating a shaft connected to a valve assembly, when the table is rotated to the dispense position, the table causes each shaft to move its respective valve assembly to provide communication between its assigned canister and its assigned dispense port, when the table is rotated to the recirculation position, the table causes each shaft to move its respective valve assembly to provide communication between its respective pump and its respective canister.

23. A dispenser for dispensing multiple fluids, comprising:

a table coupled to a table motor for rotating the table between at least two positions including a dispense position and a recirculation position;

a plurality of canisters, a plurality of pumps, a plurality of pump motors, a plurality of valve assemblies, a plurality of dispense ports and a controller linked to at least the table motor and each pump motor;

each canister in communication with its assigned pump, each pump in communication with an inlet of its assigned valve assembly, each pump being linked to its assigned pump motor;

the table coupled to the plurality of valve assemblies, each valve assembly comprises a valve housing comprising an inlet in communication with its respective pump and a recirculation outlet in communication with its respective canister, each valve housing accommodating a valve body comprising a first end connected to a handle and a second end comprising a dispense passageway, each handle is connected to a shaft, each shaft is received in a slot disposed in the table, rotation of the table between the dispense and recirculation positions causing each shaft and handle to move each valve body between the dispense and recirculation positions, each dispense passageway provides communication between the inlet of its associated valve assembly and its associated dispense port when the table and valve assemblies are in the dispense position, the valve body further comprising a recirculation slot that provides communication between the inlet and the recirculation outlet of its respective valve housing when the table and valve assemblies are in the recirculation position.

* * * * *